US007116049B2

(12) United States Patent
Machida

(10) Patent No.: US 7,116,049 B2
(45) Date of Patent: Oct. 3, 2006

(54) DISCHARGE TUBE WITH A SPECIFIC AMOUNT OF HYDROGEN GAS BY VOLUME

(75) Inventor: Kazuhiko Machida, Nagano (JP)

(73) Assignee: Shinko Electric Industries Co., Ltd., Nagano (JP)

( * ) Notice: Subject to any disclaimer, the term of this patent is extended or adjusted under 35 U.S.C. 154(b) by 50 days.

(21) Appl. No.: 10/759,968

(22) Filed: Jan. 16, 2004

(65) Prior Publication Data

US 2004/0150346 A1 Aug. 5, 2004

(30) Foreign Application Priority Data

Jan. 30, 2003 (JP) ..... 2003-022188

(51) Int. Cl.
*H01J 61/12* (2006.01)

(52) U.S. Cl. ..... 313/637; 313/642; 313/643; 313/576; 313/484

(58) Field of Classification Search ..... 313/637, 313/641, 642, 643, 567, 576, 484
See application file for complete search history.

(56) References Cited

U.S. PATENT DOCUMENTS 1,648,293 A * 11/1927 Charlton ..... 313/569
2,103,038 A * 12/1937 Moers ..... 313/639
2,291,864 A * 8/1942 Bennett ..... 313/597
3,858,077 A 12/1974 Bazarian et al.
4,437,845 A 3/1984 Schleimann-Jensen
4,801,841 A * 1/1989 Driscoll ..... 313/112
4,882,520 A * 11/1989 Tsunekawa et al. ..... 313/643
5,892,648 A 4/1999 Bobert et al.
6,121,730 A * 9/2000 Ukegawa et al. ..... 313/638
6,362,945 B1 3/2002 Bobert et al.

FOREIGN PATENT DOCUMENTS

| | | |
|---|---|---|
| EP | 0869529 | 10/1998 |
| GB | 1222841 | 4/1968 |
| GB | 1439775 | 11/1973 |
| JP | 10-355042 | 12/1998 |

* cited by examiner

*Primary Examiner*—K Guharay
*Assistant Examiner*—Anthony Canning
(74) *Attorney, Agent, or Firm*—Ladas & Parry LLP

(57) ABSTRACT

In a discharge tube of the present invention, a filler gas is composed of a mixture of inert gas and hydrogen gas and an airtight cylinder 10 in which the filler gas is enclosed in an airtight manner is provided. A pair of first and second discharge electrodes 22 and 24 are opposed to each other within an internal space of the airtight cylinder, so that an electric discharge is generated between discharging surfaces of the first and second discharge electrodes. In the discharge tube, a concentration of the hydrogen gas in the filler gas is set in a range from 20 percent by volume to 80 percent by volume.

8 Claims, 15 Drawing Sheets

DISCHARGE TUBE WITH A SPECIFIC AMOUNT OF HYDROGEN GAS BY VOLUME

CROSS-REFERENCE TO RELATED APPLICATION

This application is based upon and claims the benefit of priority from the prior Japanese patent application No. 2003-022188, filed on Jan. 30, 2003, the entire contents of which are incorporated herein by reference.

BACKGROUND OF THE INVENTION

1. Field of the Invention

The present invention generally relates to a discharge tube, and more particularly to a discharge tube in which an upper discharge electrode and a lower discharge electrode are opposed to each other in an airtight cylinder, and an electric discharge is repeatedly generated between the discharging surfaces of the upper and lower discharge electrodes.

2. Description of the Related Art

For example, a HID (high intensity discharge) headlamp for automotive vehicle requires an ignitor circuit which generates a high-voltage trigger in order to turn on the light. The ignitor circuit is mainly comprised of a capacitor which charges the electricity, a transformer which generates the high-voltage trigger, and a switching discharge tube which generates a stable voltage pulse. In the following description, this switching discharge tube will be called the discharge tube.

As disclosed in Japanese Laid-Open Patent Application No. 10-335042, the above-mentioned discharge tube is comprised of an airtight cylinder made of an insulating material, such as ceramics, and first and second discharge electrodes arranged to the end openings of the airtight cylinder. A discharging gap is formed between the first discharge electrode and the second discharge electrode within the airtight cylinder, and the filler gas is enclosed in the airtight cylinder in an airtight manner.

In the above-mentioned discharge tube, an electric discharge is generated at the discharging gap of the airtight cylinder with the presence of the filler gas therein. Conventionally, the filler gas used is a mixture of argon (Ar) gas as the major component and hydrogen ($H_2$) gas in a volume concentration above 0.5% and below 20%.

The development of the conventional discharge tube has been carried out with emphasis given on the generation of a stable voltage pulse. However, with the recent demand of high-density assembly of the ignitor circuit in the automotive HID headlamp, it becomes necessary to increase the output voltage of the secondary coil of the transformer in addition to the generation of a stable voltage pulse by the discharge tube.

FIG. 1A and FIG. 1B are diagrams for explaining a transition of the operating voltage of a conventional discharge tube immediately after a start of discharging.

The filler gas of the discharge tube of FIG. 1A and FIG. 1B is composed of 90% by volume of argon (Ar) gas and 10% by volume of hydrogen ($H_2$) gas. In the following, all the chemical composition (%) of the filler gas is expressed in the volume concentration (percent by volume) unless otherwise specified.

Moreover, FIG. 2A and FIG. 2B are diagrams for explaining the results of measurement of an output voltage of the secondary coil of the transformer of the ignitor circuit to which the conventional discharge tube (the composition of the filler gas: 90% Ar+10% $H_2$) of FIG. 1A and FIG. 1B is applied.

In addition, in the cases of FIG. 1A and FIG. 1B, the connection of the discharge tube is made in the "plus" direction and the "minus" direction, respectively. Namely, the direction of the connection is reversed between the cases of FIG. 1A and FIG. 1B.

As is apparent from FIG. 1A and FIG. 1B, after a start of discharging of the conventional discharge tube, the operating voltage is not reduced to the ground in a straight manner, but the phenomenon takes place in which the discharge voltage is raised for a certain period after the start of discharging, as indicated by the arrow A in FIG. 1A and FIG. 1B. In the following, this phenomenon will be called the rebound phenomenon and the discharge voltage at this time will be called the rebound voltage. The rebound phenomenon takes place regardless of whether the connection direction of the discharge tube is the "plus" direction or the "minus" direction as shown in FIG. 1A and FIG. 1B.

Moreover, as shown in FIG. 2A and FIG. 2B, the actual output voltage of the secondary coil of the transformer of the ignitor circuit at this time declines greatly, although the desired value of the output voltage is about 11 kV. This is because the decline of the output voltage is caused by the above mentioned rebound phenomenon.

SUMMARY OF THE INVENTION

An object of the present invention is to provide an improved discharge tube in which the above-mentioned problems are eliminated.

An object of the present invention is to provide a discharge tube which can effectively suppress the occurrence of the rebound phenomenon.

The above-mentioned objects of the present invention are achieved by a discharge tube comprising: a filler gas being composed of a mixture of inert gas and hydrogen gas; an airtight cylinder in which the filler gas is enclosed in an airtight manner; and a pair of first and second discharge electrodes opposed to each other within an internal space of the airtight cylinder, so that an electric discharge is generated between discharging surfaces of the first and second discharge electrodes, wherein a concentration of the hydrogen gas in the filler gas is set in a range from 20 percent by volume to 80 percent by volume.

According to the discharge tube of the present invention, it is possible to suppress the occurrence of the rebound phenomenon immediately after a start of discharging. Moreover, according to the discharge tube of the present invention, it is possible to suppress the decline of the discharge life of the discharge electrode. Moreover, according to the discharge tube of the present invention, it is possible to provide stable generation of the discharge starting voltage.

BRIEF DESCRIPTION OF THE DRAWINGS

Other objects, features and advantages of the present invention will become apparent from the following detailed description when read in conjunction with the accompanying drawings.

DETAILED DESCRIPTION OF PREFERRED EMBODIMENTS

A description will now be provided of the preferred embodiments of the present invention with reference to the accompanying drawings.

Figure 3:
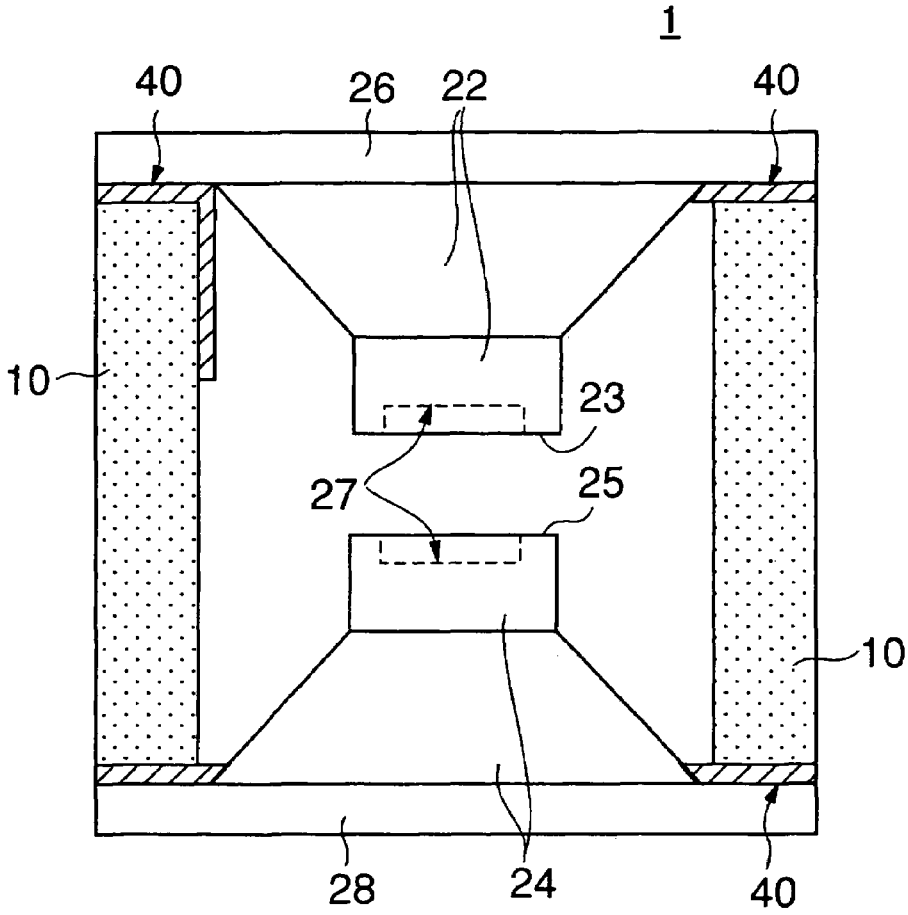
FIG. 3 is a cross-sectional view of an embodiment of the discharge tube of the invention.
Figure 4:
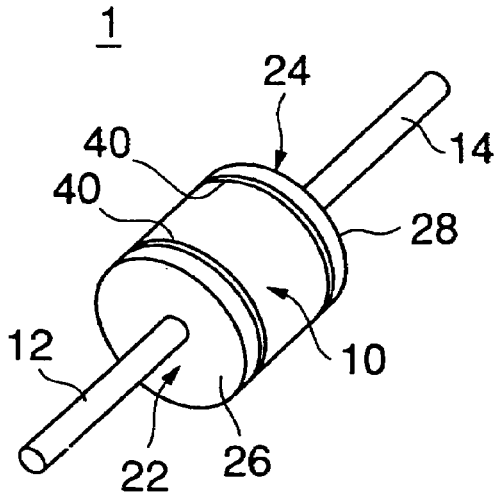
FIG. 4 is a perspective view of an embodiment of the discharge tube of the invention.

FIG. 3 and FIG. 4 show an embodiment of the discharge tube of the present invention. Specifically, FIG. 3 is a cross-sectional view of the discharge tube 1, and FIG. 4 is a perspective view of the appearance of the discharge tube 1.

As shown in FIG. 3, the discharge tube 1 is generally comprised of an airtight cylinder 10, an upper discharge electrode 22, a lower discharge electrode 24, and a filler gas contained in the airtight cylinder 10. The airtight cylinder 10 is in the shape of a cylinder and it is made of an insulating material, such as ceramics.

The upper discharge electrode 22 and the lower discharge electrode 24, which are made of a metallic material, such as the 42 Fe—Ni alloy, respectively, are joined to the upper and lower end openings of the airtight cylinder 10. In addition, the material of the upper and lower discharge electrodes 22 and 24 is not limited to the 42 Fe—Ni alloy. Alternatively, other materials, such as Kovar and Fe—Ni—Cr alloy may be used for the discharge electrodes 22 and 24.

A disk-shaped lid member 26 and a disk-shaped lid member 28 are integrally formed with the upper discharge electrode 22 and the lower discharge electrode 24 respectively, and metallization surfaces 40 are formed on the upper and lower end openings of the airtight cylinder 10.

The upper discharge electrode 22 and the lower discharge electrode 24 are joined to the airtight cylinder 10 by brazing of the lid members 26 and 28 integrally formed with the discharge electrodes 22 and 24, to the metallization surfaces 40 formed on the end openings of the airtight cylinder 10.

In the airtight cylinder 10, the filler gas is enclosed when performing the above joining of the electrodes 22 and 24. Thus, the hermetic seal of the filler gas enclosed in the airtight cylinder 10 is carried out to the airtight cylinder 10 by joining of the upper discharging surface 23 and the upper discharge electrode 22.

In addition, the chemical composition of the filler gas will be described later, for the sake of convenience of description.

The upper discharge electrode 22 projects towards the center of the airtight cylinder 10 from the lid member 26, and the leading edge of the discharge electrode 22 is formed into the shape of a pillar having a small diameter. Moreover, the discharging surface 23 (which will be called the upper discharging surface 23) is formed at the leading edge of the discharge electrode 22 where the small-diameter pillar is formed. Moreover, the cavity 27 for making the generation of electric discharge stable is formed in the upper discharging surface 23.

Similarly, the lower discharge electrode 24 projects towards the center of the airtight cylinder 10 from the lid member 28, and the leading edge of the discharge electrode 24 is formed into the shape of a pillar having a small diameter. Moreover, the discharging surface 25 (which will be called the lower discharging surface 25) is formed at the leading edge of the discharge electrode 24 where the small-diameter pillar is formed. Moreover, the cavity 27 for making the generation of electric discharge stable, which is opposed to the cavity 27 in the upper discharging surface 23, is formed also in the lower discharging surface 25.

In the present embodiment, copper plating is performed on each of the upper discharging surface 23 and the lower discharging surface 25.

The electric discharge in the discharge tube 1 is generated at an intermediate portion which is distant from both the upper discharging surface 23 and the lower discharging surface 25. In the following, the intermediate portion between the upper discharging surface 23 and the lower discharging surface 25 will be called the discharging gap 29.

In the discharge tube 1 of the present embodiment, copper plating is performed on each of the upper discharging surface 23 of the upper discharge electrode 22 and the lower discharging surface 25 of the lower discharge electrode 24. At the same time, any of the metallic materials including the 42 Fe—Ni alloy, Kovar, Fe—Ni—Cr alloy, etc. is used as the material of the upper and lower discharge electrodes 22 and 24. It is desirable that the thickness of the copper plating is in a range from several micrometers to 20 micrometers.

As described above, the airtight cylinder 10 is made of the insulating material, such as ceramics, and each of the discharge electrodes 22 and 24 is brazed to the airtight cylinder 10. For this reason, by using the metallic material such as 42 Fe—Ni alloy, Kovar, Fe—Ni—Cr alloy, etc. that has a coefficient of thermal expansion with a small difference from that of the ceramics as the material of the discharge electrodes 22 and 24, reliable brazing junction of the airtight cylinder 10 and the electrodes 22 and 24 can be attained, and the reliability of the discharge tube 1 can be raised.

Moreover, when compared with the discharge electrode which is made of copper only, the decline of the electric discharge life of the discharge electrodes 22 and 24 according to the present embodiment can be suppressed by using the above-mentioned metallic material for the discharge electrodes 22 and 24.

However, the occurrence of a corona discharge in the dark place will be delayed because the metallic material has a comparatively low electrical conductivity when the above-mentioned metallic material is used as the material of each of the discharge electrodes 22 and 24. If the discharge tube 1 using the above metallic material starts the discharging with the delayed occurrence of the corona discharge, the phenomenon in which the value of the first discharge starting voltage (FVs) is higher than the value of the subsequent discharge starting voltage (Vs) may take place.

To eliminate the problem, in the present embodiment, copper plating is performed all over each of the discharging surfaces 23 and 25 of the respective discharge electrodes 22 and 24. Accordingly, it is possible for the present embodiment to make the value of the first discharge starting voltage (FVs) close to the value of the subsequent discharge starting voltage (Vs). In addition, it is possible for the present embodiment to increase the electric discharge life of the discharge electrodes 22 and 24 and minimize the variations in the electric discharge characteristics of the electrodes 22 and 24.

FIG. 7A through FIG. 7D are diagrams for explaining the results of the discharge life test of the discharge tube 1 of the first preferred embodiment. The discharge life test is actually carried out for four test pieces of the discharge tube 1.

Figure 8A:
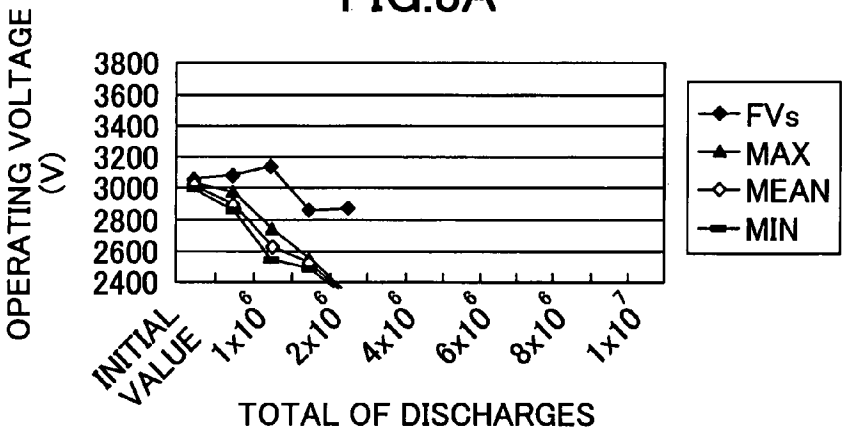
FIG. 8A, FIG. 8B and FIG. 8C are diagrams for explaining the results of the discharge life test of a discharge tube of a comparative example.
Figure 8B:
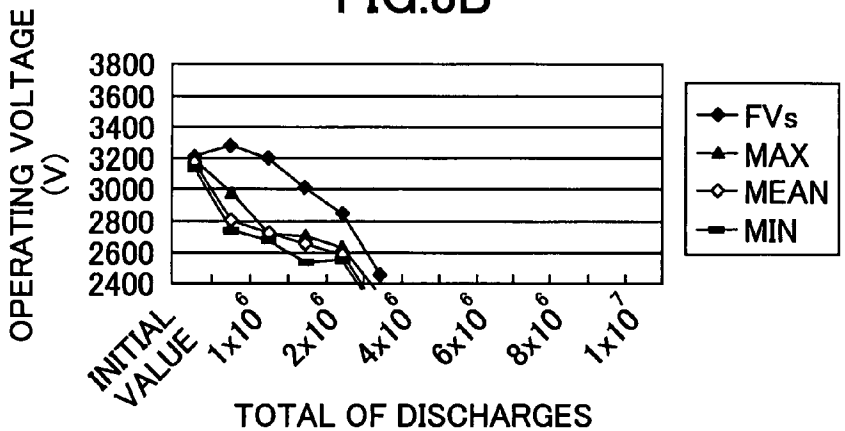
Figure 8C:
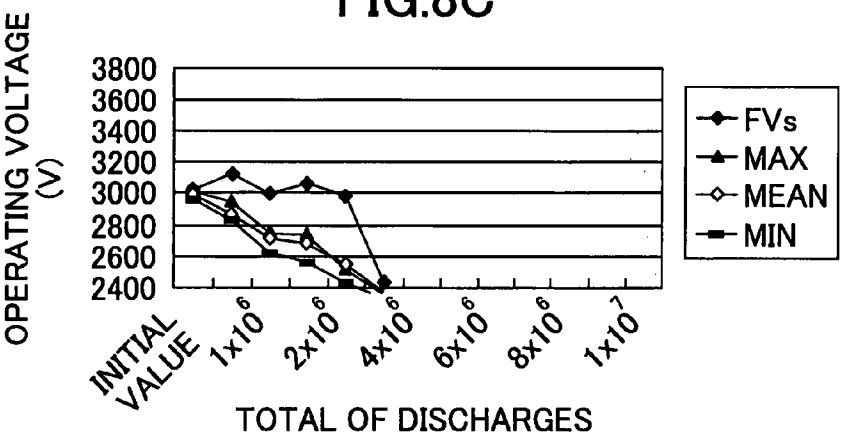

In addition, FIG. 8A through FIG. 8C are diagrams for explaining the results of the discharge life test of a discharge tube of a comparative example. This comparative example has the same specifications as the discharge tube 1 of the present embodiment, but copper plating is not performed onto the discharging surfaces of the discharge tube of the comparative example. The discharge life test which is the same as that of FIG. 7A–FIG. 7D is actually carried out for three test pieces of the discharge tube of the comparative example.

As shown in FIG. 7A–FIG. 7D, the discharge tube 1 of the present embodiment maintains the electric discharge operating voltage, which remains almost unchanged from the initial value thereof, even when the total of electric discharges reaches 10 million times. It is turned out that the discharge tube 1 of the present embodiment has a long discharge life.

On the other hand, it is impossible to generate an electric discharge with the discharge tube (without copper plating) of the comparative example of FIG. 8A–FIG. 8C before the total of electric discharges reaches 4 million times.

As is apparent from the experimental results of FIG. 7A–FIG. 7D and FIG. 8A–FIG. 8C, it is proved that the discharge tube 1 of this embodiment provides a long discharge life.

Next, a description will be given of the chemical composition of the filler gas in the discharge tube of the present invention.

The filler gas in the discharge tube 1 serves to eliminate the ions created within the airtight cylinder 10 during the electric discharge operation of the discharge tube 1, which will be called the deionization function.

If the deionization function of the filler gas is insufficient, the electric current is left during the continuous generation of electric discharge, and it is difficult to generate stable electric discharge. Such a condition of the discharge tube 1 is not desirable.

When only the inert gas (for example, Ar gas) is enclosed in the discharge tube as the filler gas, it is known that the deionization function becomes poor or deteriorates. To avoid this, the preventive measure against the deterioration of the deionization function of the filler gas is taken by mixing a small amount of hydrogen gas with the inert gas (such as Ar gas).

According to the present invention, the discharge tube is characterized by setting the concentration of hydrogen gas in the filler gas in a range from 20% (percent by volume) to 80% (percent by volume).

Especially, the discharge tube 1 of the first preferred embodiment is characterized by using a particularly selected chemical composition of the filler gas in which the concentration of the argon gas in the filler gas is set in 80% by volume and the concentration of the hydrogen gas in the filler gas is set in 20 percent by volume. In the following, the chemical composition of the filler gas for the present embodiment is expressed as like (80% Ar+20% $H_2$).

Figure 5A:
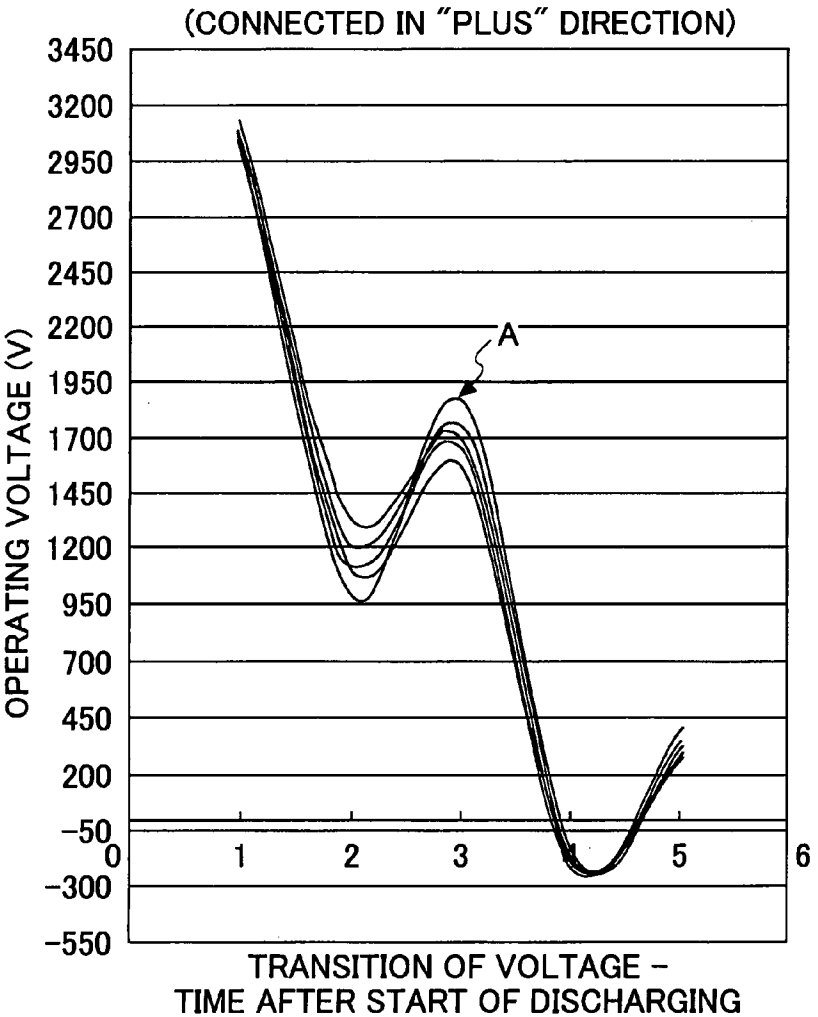
FIG. 5A and FIG. 5B are diagrams for explaining a transition of the operating voltage of a first preferred embodiment of the discharge tube of the invention after a start of discharging.
Figure 5B:
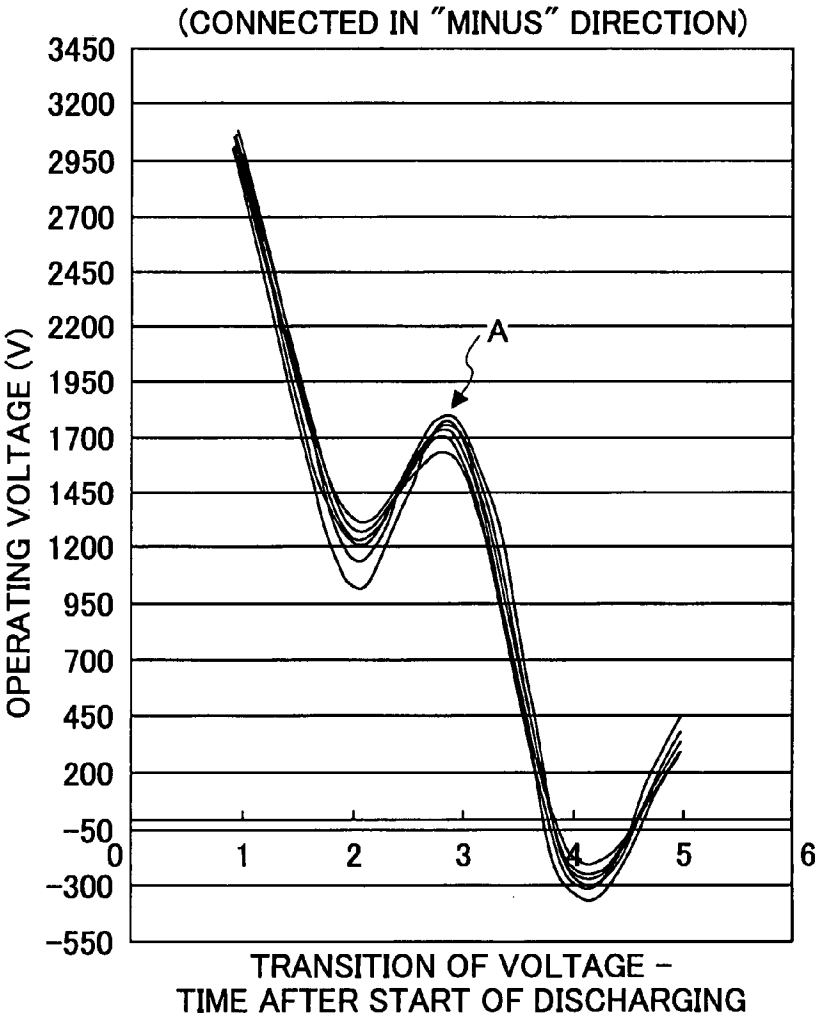

FIG. 5A and FIG. 5B are diagrams for explaining a transition of the operating voltage of the discharge tube 1 (80% Ar+20% $H_2$) of the first preferred embodiment immediately after a start of discharging.

As shown in FIG. 5A and FIG. 5B, the operating voltage of the discharge tube 1 is set in a voltage range from 400V to 6000V.

Figure 6A:
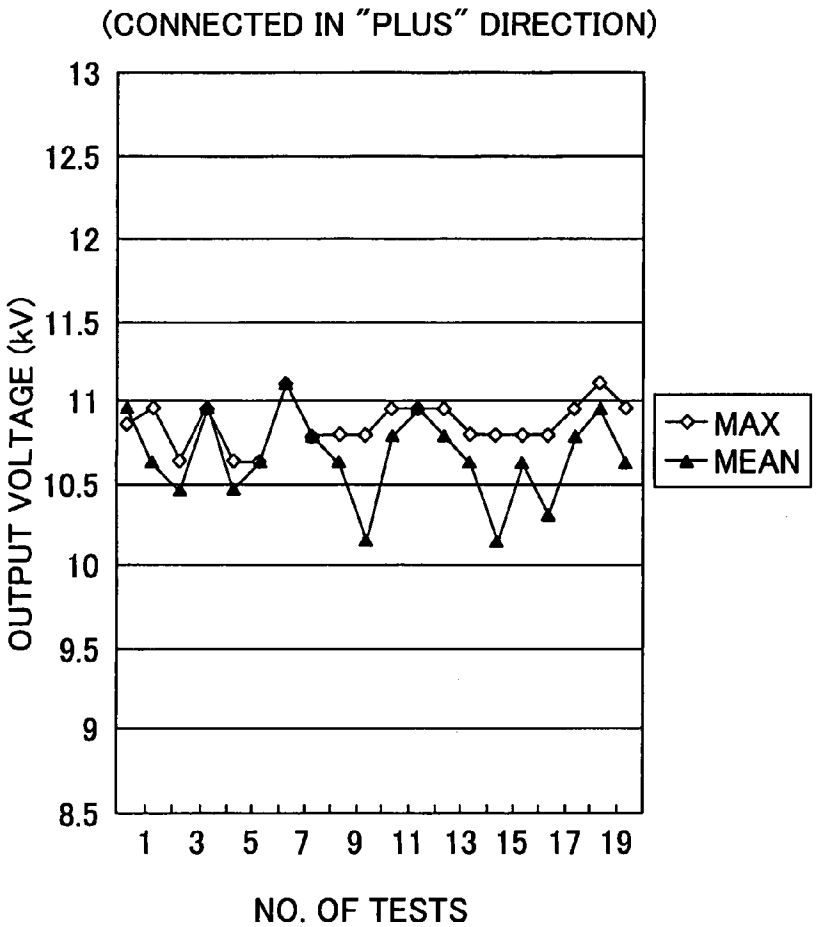
FIG. 6A and FIG. 6B are diagrams for explaining results of measurement of an output voltage of the secondary coil of the transformer with the discharge tube of the first preferred embodiment used.
Figure 6B:
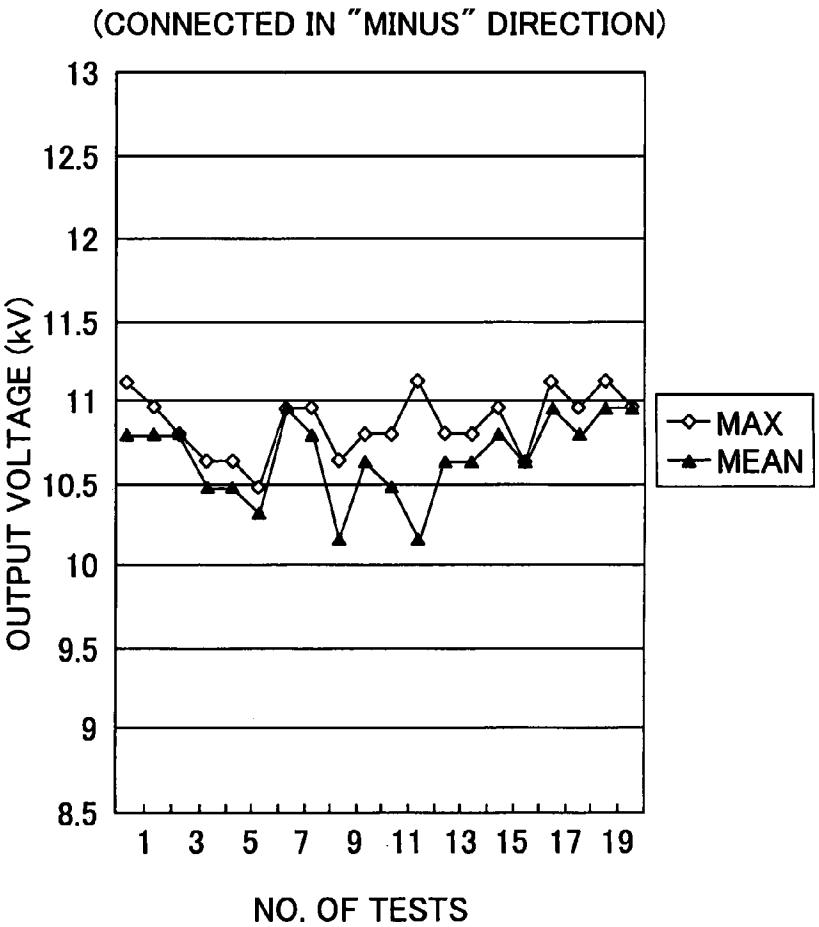
Figure 7A:
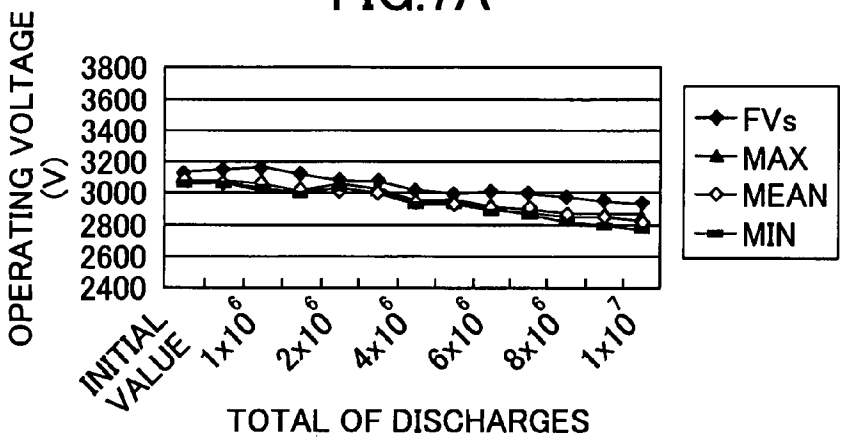
FIG. 7A, FIG. 7B, FIG. 7C, and FIG. 7D are diagrams for explaining the results of the discharge life test of the discharge tube of the first preferred embodiment.
Figure 7B:
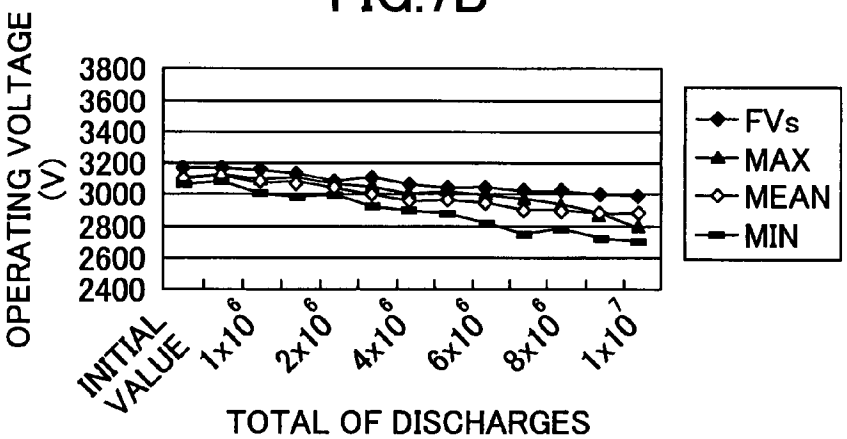
Figure 7C:
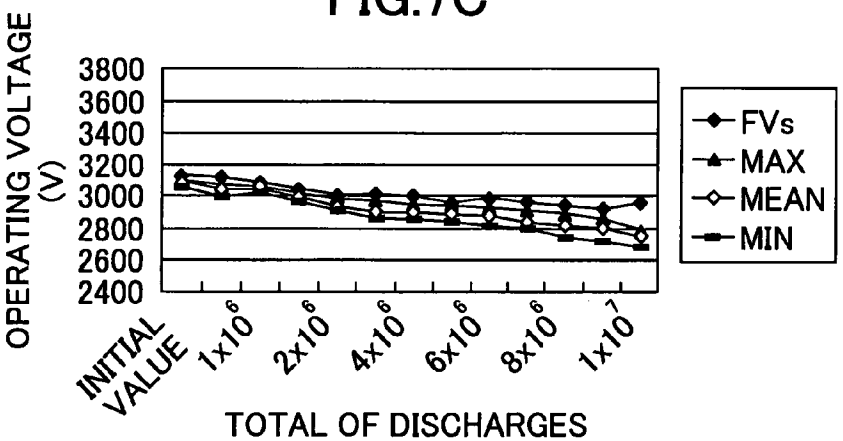
Figure 7D:
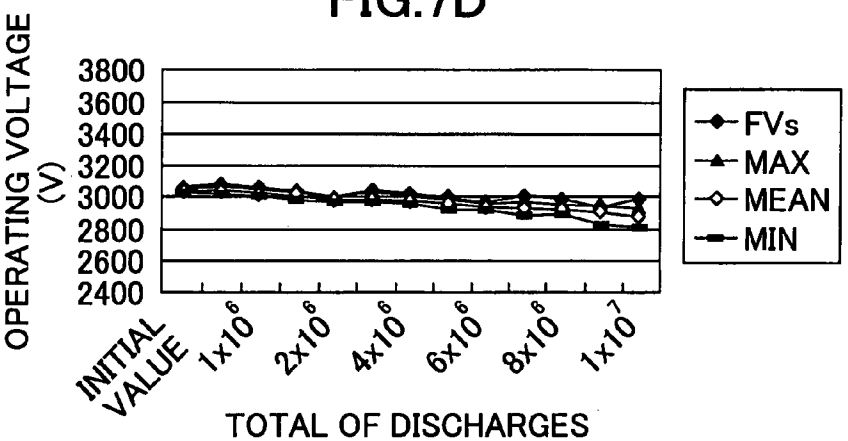

Moreover, FIG. 6A and FIG. 6B are diagrams for explaining the results of measurement of an output voltage of the secondary coil of the transformer of the ignitor circuit to which the discharge tube 1 of the first preferred embodiment (the composition of the filler gas: 80% Ar+20% $H_2$) is applied.

In the cases of FIG. 5A and FIG. 5B, the connection of the discharge tube 1 is made in the "plus" direction and the "minus" direction, respectively. Namely, the direction of the connection is reversed between the cases of FIG. 5A and FIG. 5B. The same discussion is applicable to the subsequent preferred embodiments which will be explained later.

Figure 1A:
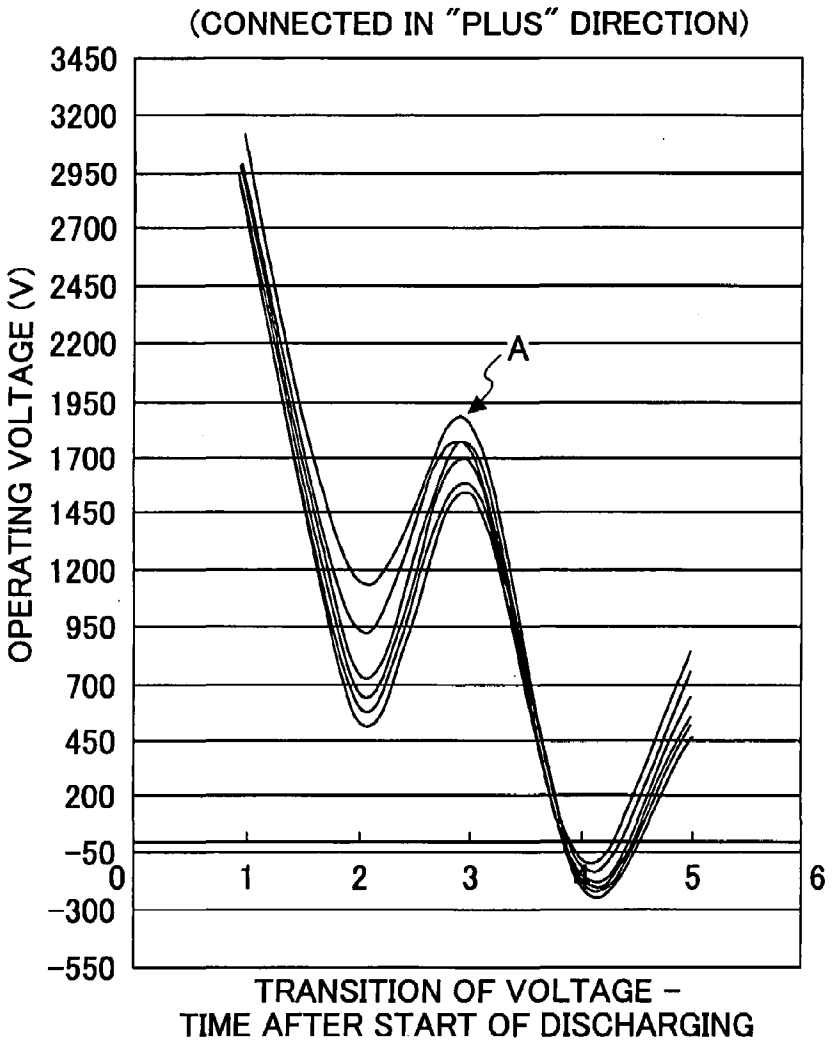
FIG. 1A and FIG. 1B are diagrams for explaining a transition of the operating voltage of a conventional discharge tube after a start of discharging.
Figure 1B:
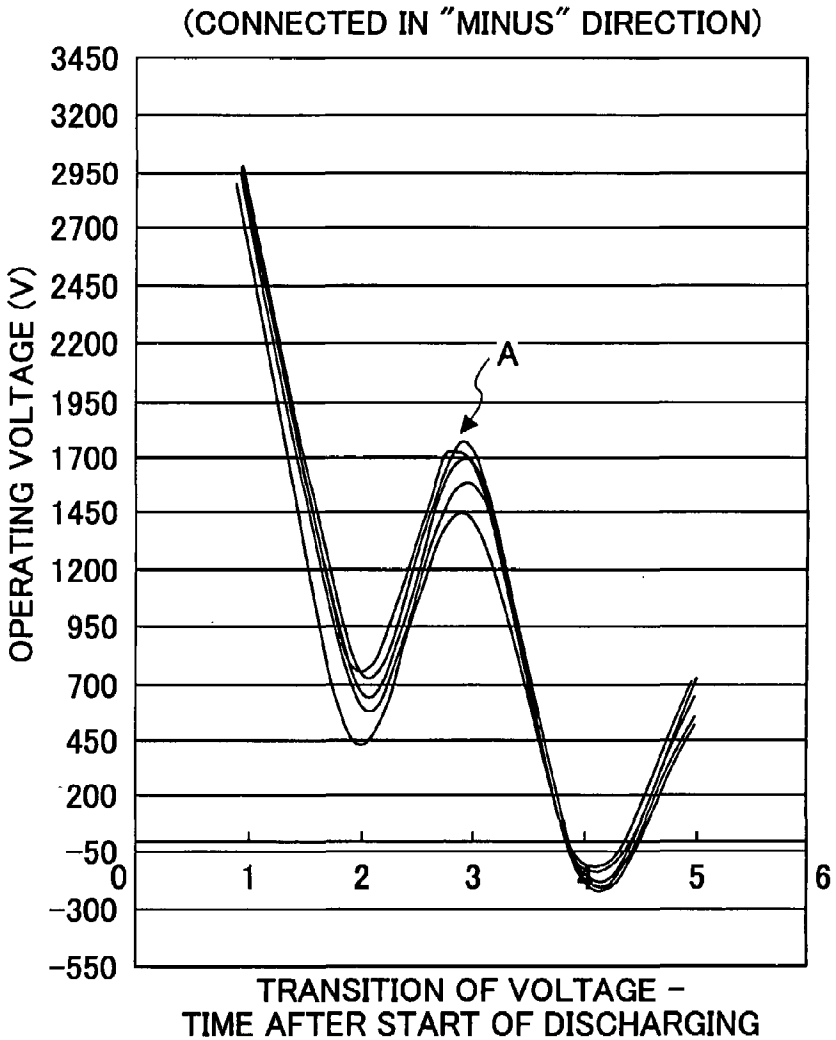
Figure 2A:
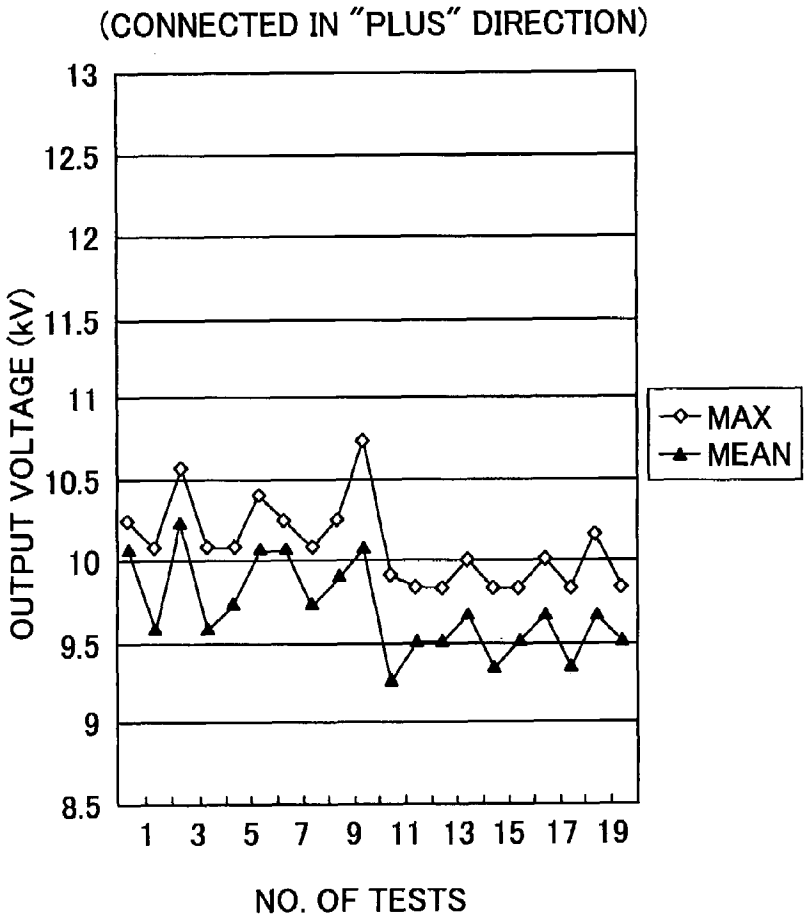
FIG. 2A and FIG. 2B are diagrams for explaining results of measurement of an output voltage of the secondary coil of the transformer with the conventional discharge tube used.
Figure 2B:
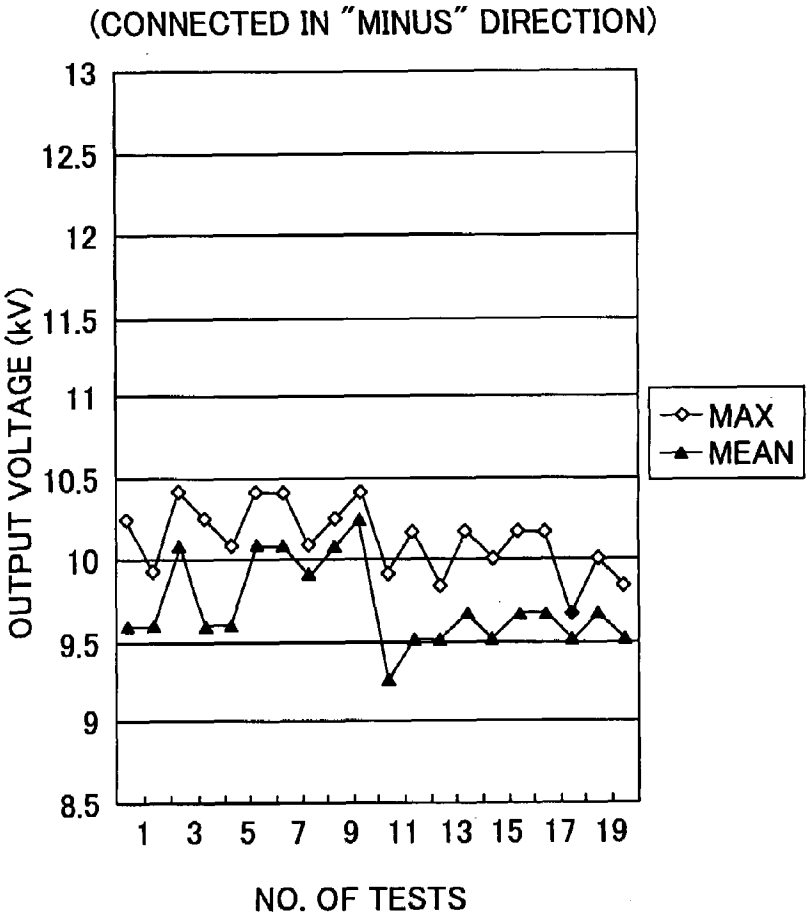

As is apparent from FIG. 5A and FIG. 5B, the rebound phenomenon similar to the case of the conventional discharge tube (FIG. 1A and FIG. 1B) can be seen in which the operating voltage of the discharge tube 1 of the present embodiment after a start of discharging is not reduced to the ground in a straight manner, but the discharge voltage is raised for a certain period after the start of discharging as indicated by the arrow A in FIG. 5A and FIG. 5B. However, the rebound phenomenon in the present embodiment is small in magnitude when compared with the conventional case (FIG. 1A and FIG. 1B).

Moreover, as shown in FIG. 6A and FIG. 6B, the actual output voltage of the secondary coil of the transformer of the ignitor circuit for the present embodiment does not decline greatly, and it is nearly equal to 11 kV which is the desired value of the output voltage.

Accordingly, by increasing the volume concentration of the hydrogen gas in the filler gas from that of the conventional case, the decline of the output voltage of the secondary coil can be suppressed, and the discharge tube of the present embodiment can meet the demand of high-density assembly of the ignitor circuit in the automotive HID headlamp.

Next, a description will be given of the second preferred embodiment of the discharge tube of the invention.

The composition of the discharge tube in each of the second and subsequent preferred embodiments is essentially the same as that of the discharge tube 1 in the first preferred embodiment except the chemical composition of the filler gas enclosed therein, and a description thereof will be omitted.

For this reason, the following description will be focused on the chemical composition of the filler gas, and a description of the composition of the discharge tube other than the filler gas will be omitted.

The discharge tube of the second preferred embodiment is characterized by setting the chemical composition of the filler gas to 70% Ar+30% $H_2$.

Figure 9A:
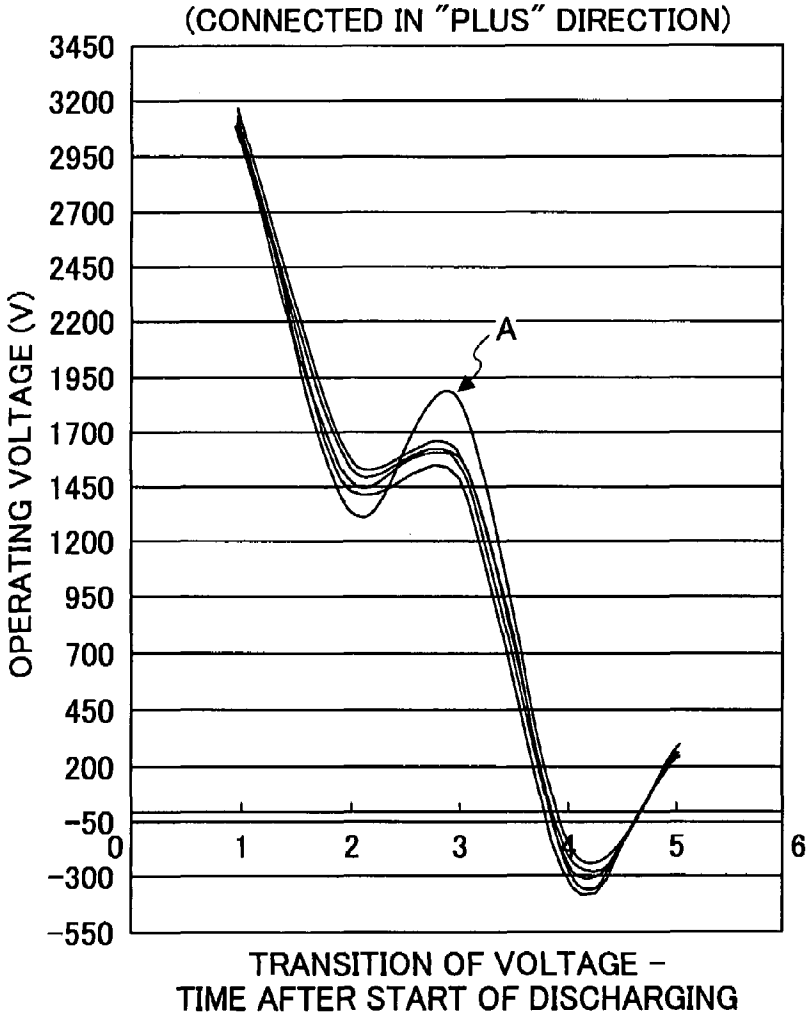
FIG. 9A and FIG. 9B are diagrams for explaining a transition of the operating voltage of a second preferred embodiment of the discharge tube of the invention after a start of discharging.
Figure 9B:
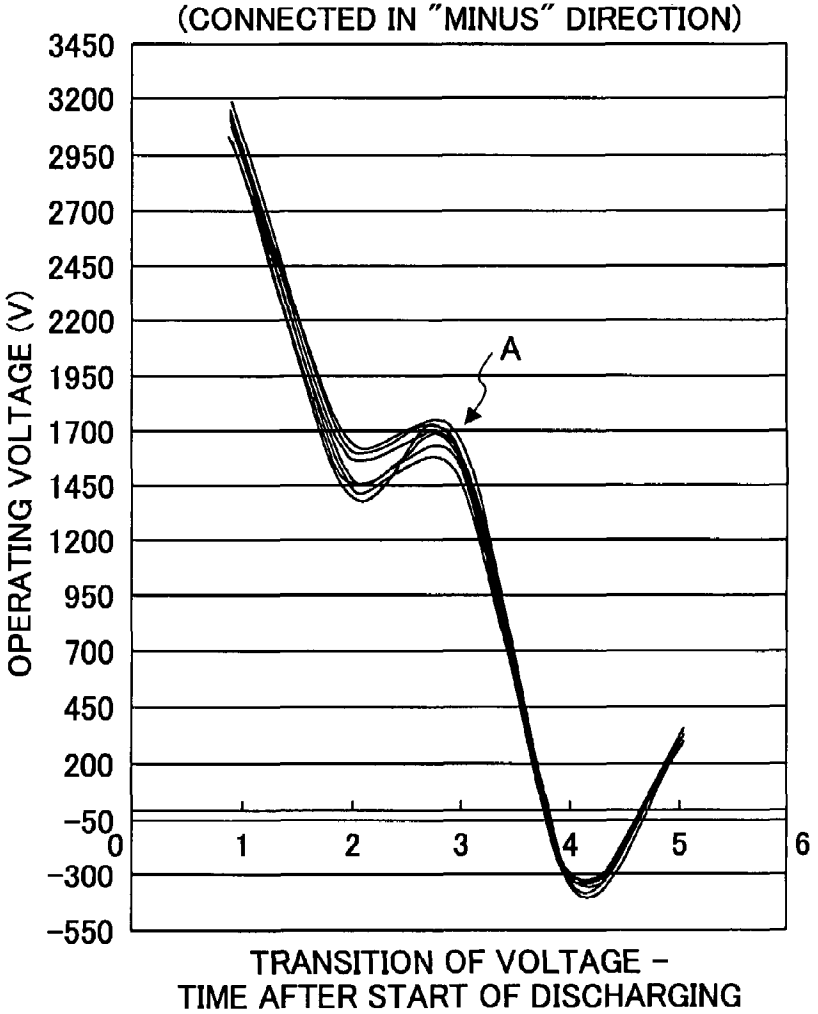

FIG. 9A and FIG. 9B are diagrams for explaining a transition of the operating voltage of the discharge tube (70% Ar+30% $H_2$) of the second preferred embodiment immediately after a start of discharging.

As shown in FIG. 9A and FIG. 9B, the operating voltage of the discharge tube of the present embodiment is also set in the range from 400V to 6000V.

Figure 10B:
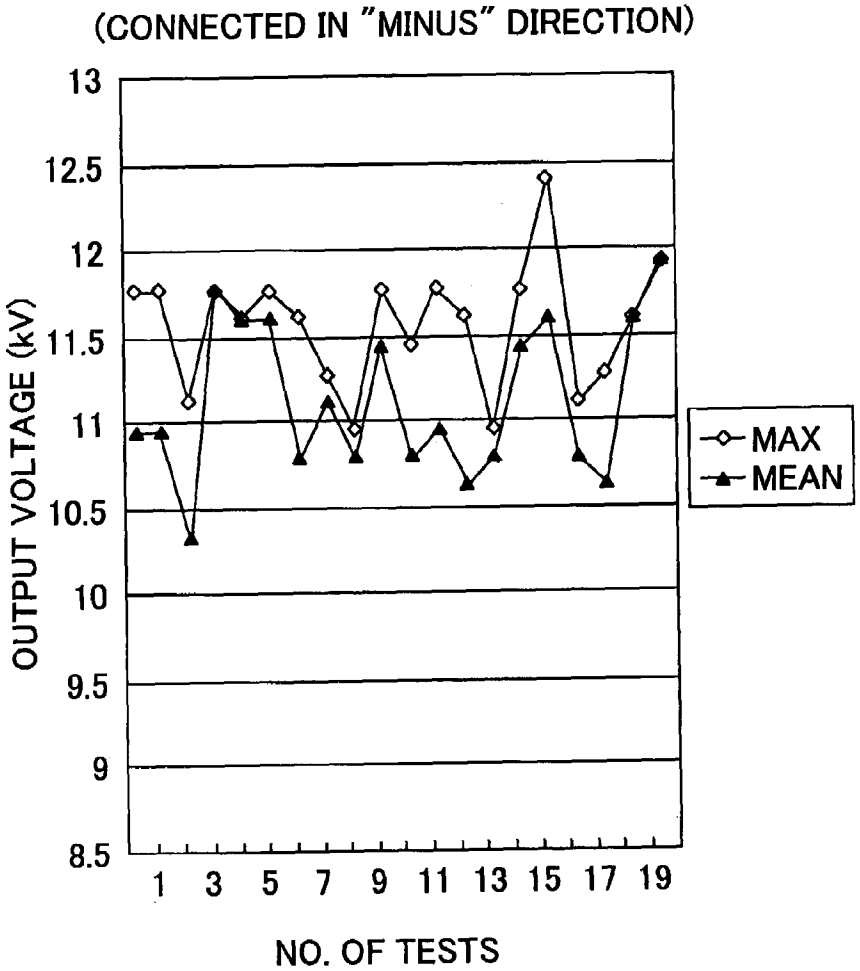
FIG. 10A and FIG. 10B are diagrams for explaining results of measurement of an output voltage of the secondary coil of the transformer with the discharge tube of the second preferred embodiment used.
Figure 10A:
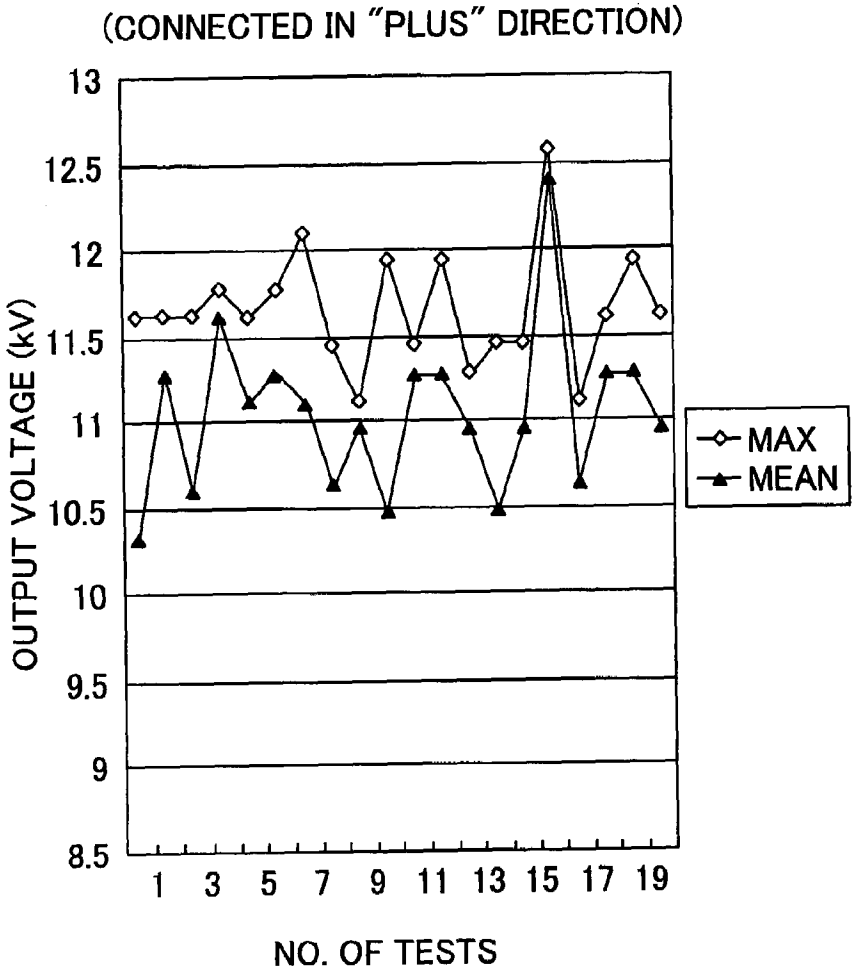

Moreover, FIG. 10A and FIG. 10B are diagrams for explaining the results of measurement of an output voltage of the secondary coil of the transformer of the ignitor circuit to which the discharge tube of the second preferred embodiment (the composition of the filler gas: 70% Ar+30% $H_2$) is applied.

As is apparent from FIG. 9A and FIG. 9B, the rebound phenomenon similar to that of the conventional discharge tube (FIG. 1A and FIG. 1B) can also be seen in which the operating voltage of the discharge tube of the present embodiment after a start of discharging is not reduced to the ground in a straight manner, but the discharge voltage is raised for a certain period after the start of discharging as indicated by the arrow A in FIG. 9A and FIG. 9B. However, the rebound phenomenon in the present embodiment is very small in magnitude when compared with that of the discharge tube 1 of the first preferred embodiment (FIG. 5A and FIG. 5B).

Moreover, as shown in FIG. 10A and FIG. 10B, the actual output voltage of the secondary coil of the transformer of the ignitor circuit for the present embodiment does not decline greatly. Although there are variations of the output voltage, it is nearly equal to 11 kV which is the desired value of the output voltage of the secondary coil of the transformer of the ignitor circuit.

In addition, when compared with the output voltage of the secondary coil of the transformer of the ignitor circuit with the discharge tube of the first preferred embodiment, the output voltage for the present embodiment approaches the desired value (11 kV) more closely.

Accordingly, by increasing the volume concentration of the hydrogen gas in the filler gas further from that of the first preferred embodiment, the decline of the output voltage of the secondary coil for the present embodiment can be suppressed more effectively, and the discharge tube of the present embodiment can meet the demand of high-density assembly of the ignitor circuit of the automotive HID headlamp.

Next, a description will be given of the third preferred embodiment of the discharge tube of the invention.

The discharge tube of the third preferred embodiment is characterized by setting the chemical composition of the filler gas to 60% Ar+40% $H_2$.

Figure 11B:
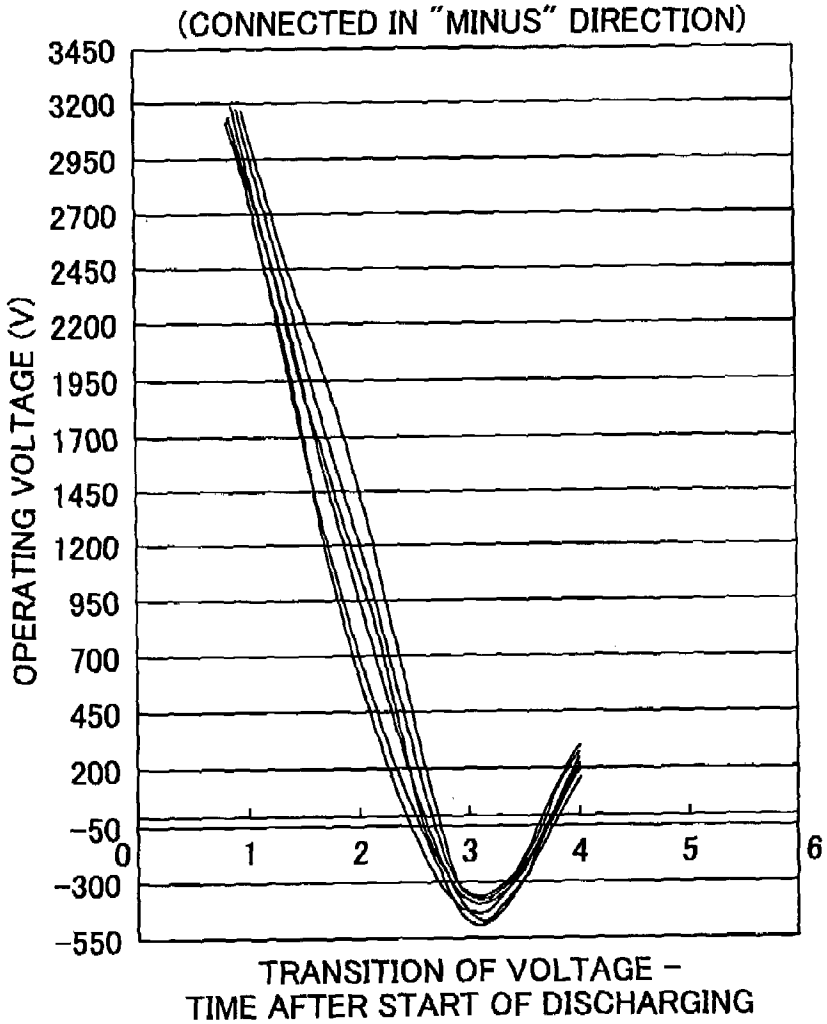
FIG. 11A and FIG. 11B are diagrams for explaining a transition of the operating voltage of a third preferred embodiment of the discharge tube of the invention after a start of discharging.
Figure 11A:
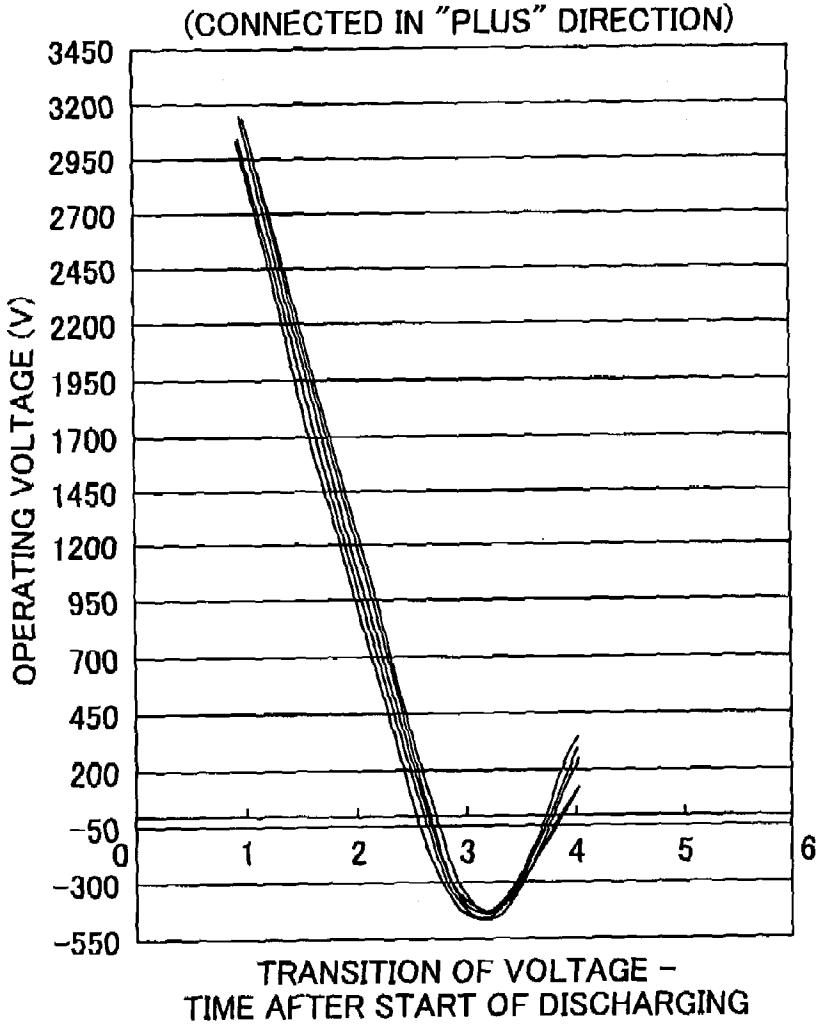

FIG. 11A and FIG. 11B are diagrams for explaining a transition of the operating voltage of the discharge tube (60% Ar+40% $H_2$) of the third preferred embodiment immediately after a start of discharging. As shown, the operating voltage of the discharge tube of the present embodiment is also set in the voltage ranging from 400V to 6000V.

Figure 12A:
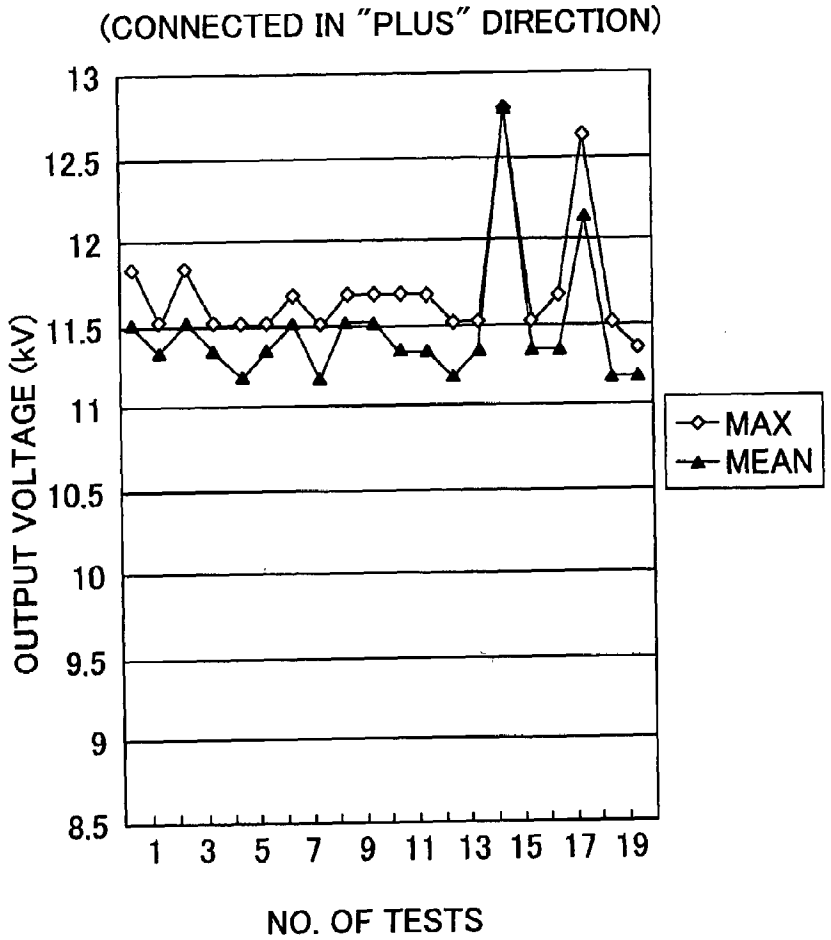
FIG. 12A and FIG. 12B are diagrams for explaining results of measurement of an output voltage of the secondary coil of the transformer with the discharge tube of the third preferred embodiment used.
Figure 12B:
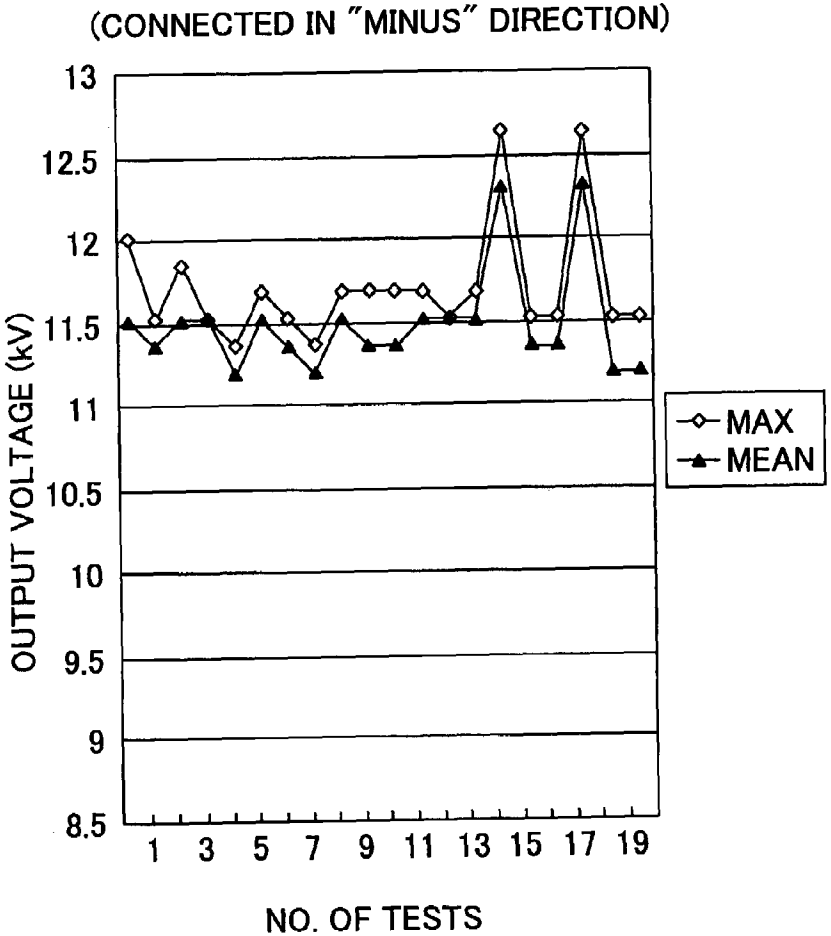

Moreover, FIG. 12A and FIG. 12B are diagrams for explaining the results of measurement of an output voltage of the secondary coil of the transformer of the ignitor circuit to which the discharge tube of the third preferred embodiment (the composition of the filler gas: 60% Ar+40% $H_2$).

As is apparent from FIG. 11A and FIG. 11B, the operating voltage of the discharge tube of the present embodiment immediately after a start of discharging is reduced to the ground in a straight manner, although there are some variations of the operating voltage. The rebound phenomenon as in the conventional case does not take place after the start of discharging.

Therefore, it should be noted that when it is intended to allow the operating voltage of the discharge tube after a start of discharging to be reduced to the ground voltage in a straight manner and avoid the rebound phenomenon, the concentration of the hydrogen gas in the filler gas is set to be above 40 percent by volume.

Moreover, as shown in FIG. 12A and FIG. 12B, the actual output voltage of the secondary coil of the transformer of the ignitor circuit for the present embodiment is approximately equal to the desired value (11 kV) of the output voltage of the secondary coil. And the variations of the output voltage for the present embodiment are smaller than those for the second preferred embodiment (FIG. 10A and FIG. 10B).

Accordingly, the decline of the output voltage of the secondary coil for the third preferred embodiment can be suppressed more effectively by increasing the volume concentration of the hydrogen gas in the filler gas from that of the second preferred embodiment.

Next, a description will be given of the fourth preferred embodiment of the discharge tube of the invention.

The discharge tube of the fourth preferred embodiment is characterized by setting the chemical composition of the filler gas to 40% Ar+60% $H_2$.

Figure 13A:
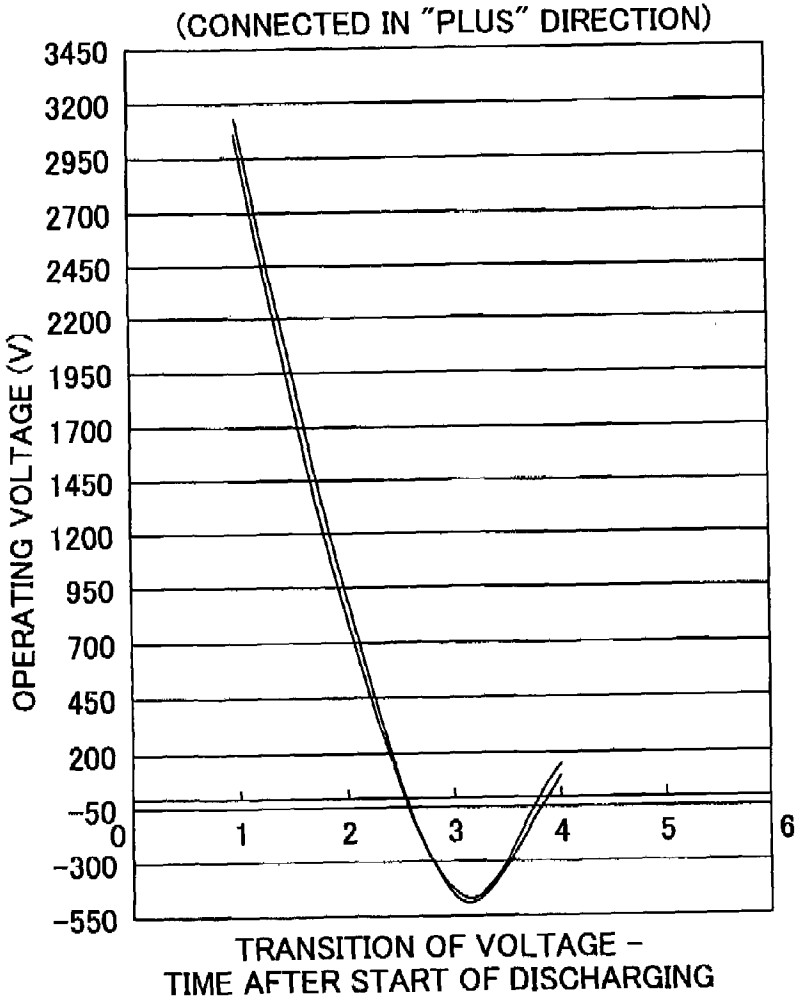
FIG. 13A and FIG. 13B are diagrams for explaining a transition of the operating voltage of a fourth preferred embodiment of the discharge tube of the invention after a start of discharging.
Figure 13B:
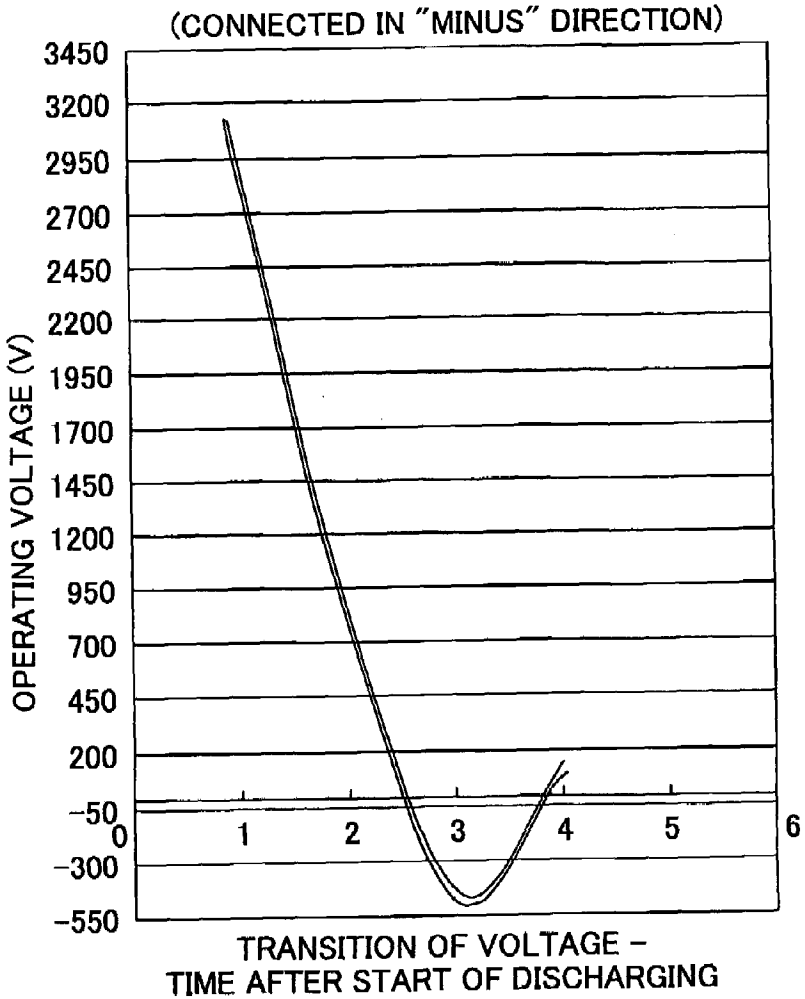

FIG. 13A and FIG. 13B are diagrams for explaining a transition of the operating voltage of the discharge tube (40% Ar+60% $H_2$) of the fourth preferred embodiment immediately after a start of discharging. As shown, the operating voltage of the discharge tube of the present embodiment is also set in the range from 400V to 6000V.

Figure 14B:
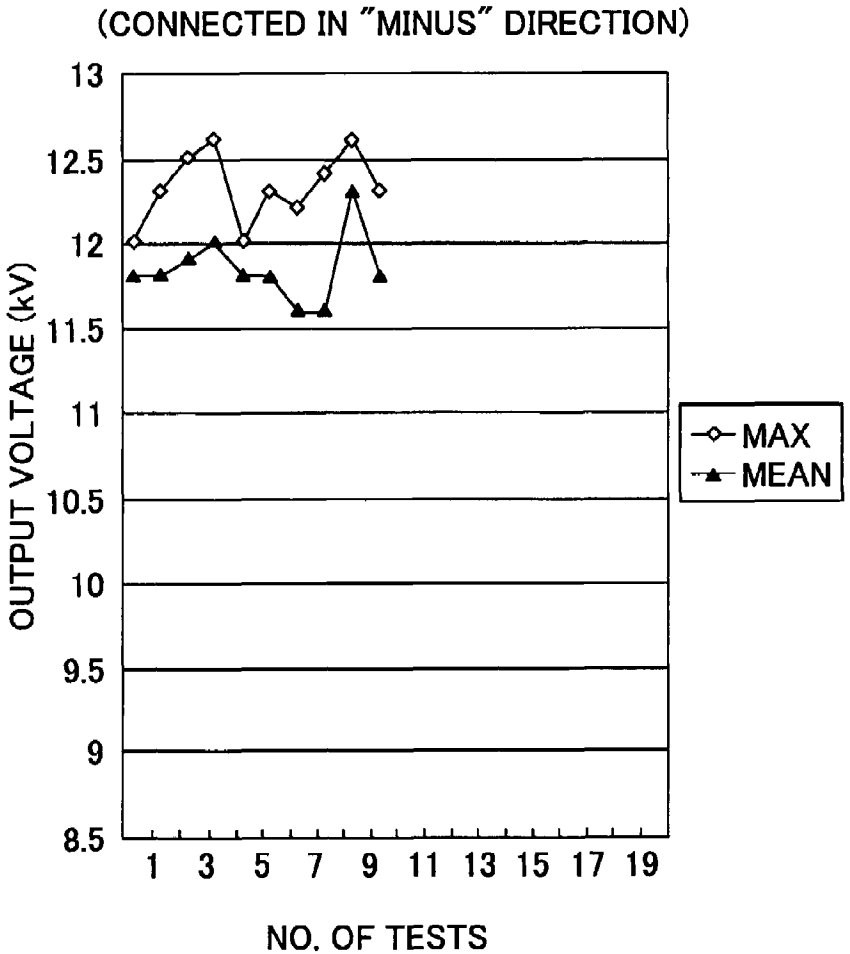
FIG. 14A and FIG. 14B are diagrams for explaining results of measurement of an output voltage of the secondary coil of the transformer with the discharge tube of the fourth preferred embodiment used.
Figure 14A:
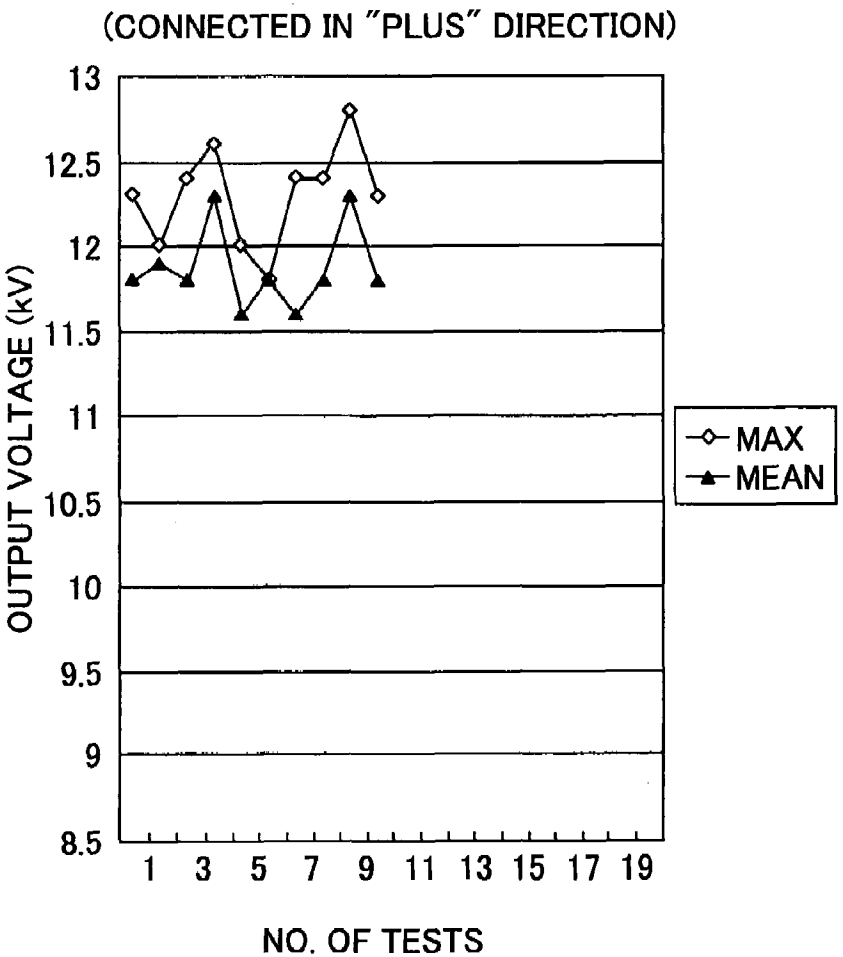

Moreover, FIG. 14A and FIG. 14B are diagrams for explaining the results of measurement of an output voltage of the secondary coil of the transformer of the ignitor circuit to which the discharge tube of the four preferred embodiment (the composition of the filler gas: 40% Ar+60% $H_2$).

As is apparent from FIG. 13A and FIG. 13B, the operating voltage of the discharge tube of the present embodiment immediately after a start of discharging is reduced to the ground in a straight manner. The rebound phenomenon as in the conventional case does not take place after the start of discharging. Moreover, the variations of the operating voltage for the present embodiment are remarkably reduced when compared with those for the third preferred embodiment, and the operating voltage for the present embodiment is stable.

Moreover, as shown in FIG. 14A and FIG. 14B, the output voltage of the secondary coil of the transformer of the ignitor circuit for the present embodiment is higher than the desired value (11 kV) of the output voltage, although there are some variations of the output voltage.

Accordingly, the output voltage of the secondary coil of the transformer of the ignitor circuit for the present embodiment can be raised by increasing the volume concentration of the hydrogen gas in the filler gas further from that of the third preferred embodiment.

Next, a description will be given of the fifth preferred embodiment of the discharge tube of the invention.

The discharge tube of the fifth preferred embodiment is characterized by setting the composition of the filler gas to 20% Ar+80% $H_2$.

Figure 15A:
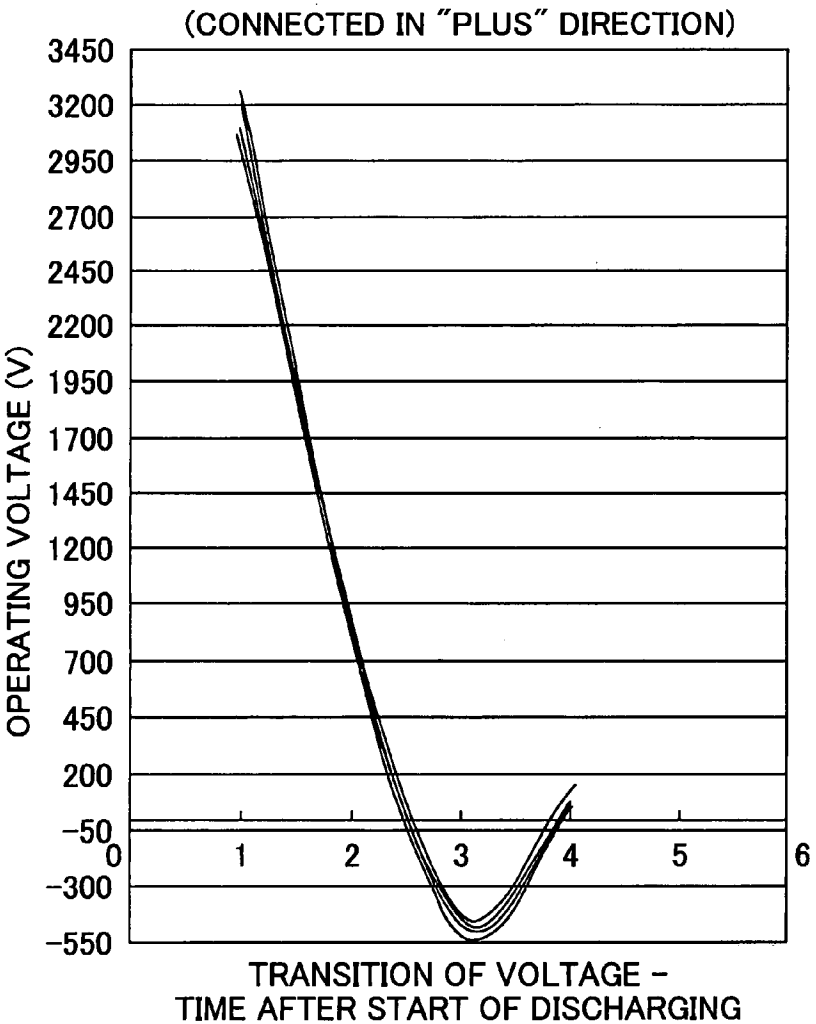
FIG. 15A and FIG. 15B are diagrams for explaining a transition of the operating voltage of a fifth preferred embodiment of the discharge tube of the invention after a start of discharging.
Figure 15B:
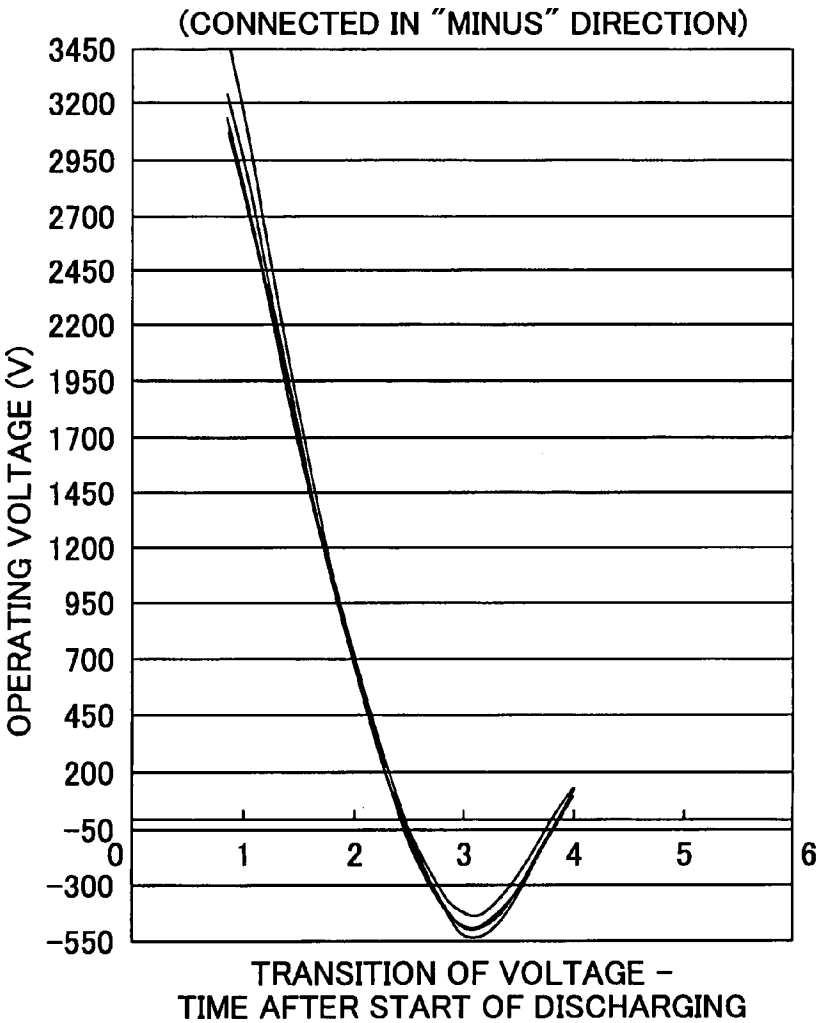

FIG. 15A and FIG. 15B are diagrams for explaining a transition of the operating voltage of the discharge tube (20% Ar+80% $H_2$) of the fifth preferred embodiment immediately after a start of discharging. As shown, the operating voltage of the discharge tube of the present embodiment is also set in the range from 400V to 6000V.

Figure 16A:
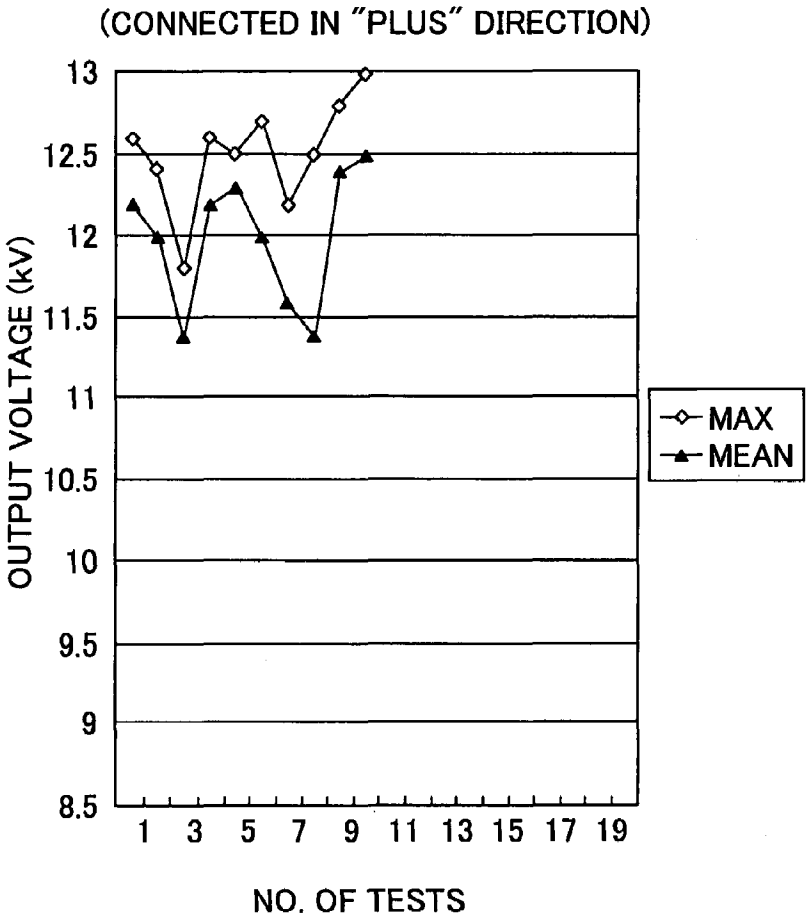
FIG. 16A and FIG. 16B are diagrams for explaining results of measurement of an output voltage of the secondary coil of the transformer with the discharge tube of the fifth preferred embodiment used.
Figure 16B:
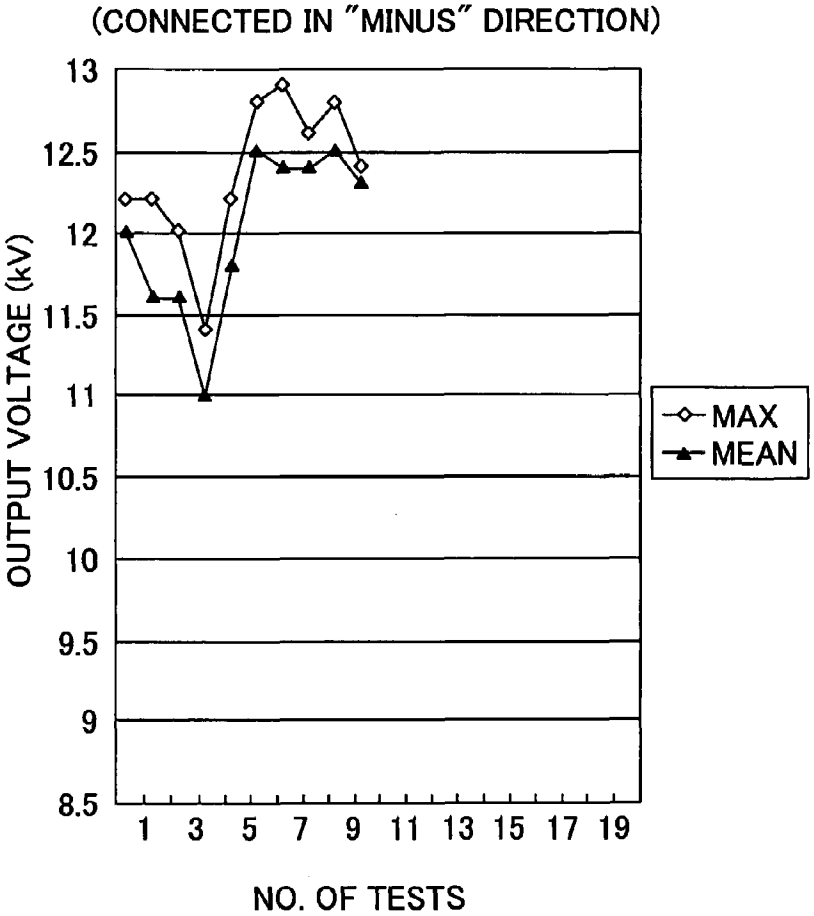

Moreover, FIG. 16A and FIG. 16B are diagrams for explaining the results of measurement of an output voltage of the secondary coil of the transformer of the ignitor circuit to which the discharge tube of the fifth preferred embodiment (the composition of the filler gas: 20% Ar+80% $H_2$) is applied.

As is apparent from FIG. 15A and FIG. 15B, the operating voltage of the discharge tube of the present embodiment immediately after a start of discharging is reduced to the ground in a straight manner, which is similar to the fourth preferred embodiment. The rebound phenomenon as in the conventional case does not take place after the start of discharging. Moreover, the variations of the operating voltage for the present embodiment are remarkably reduced, and the operating voltage for the present embodiment is stable.

Moreover, as shown in FIG. 16A and FIG. 16B, the output voltage of the secondary coil of the transformer of the ignitor circuit for the present embodiment is higher than the desired value (11 kV) of the output voltage, although there are some variations of the output voltage.

Accordingly, similar to the fourth preferred embodiment, the output voltage of the secondary coil of the transformer of the ignitor circuit for the present embodiment can be raised by increasing the volume concentration of the hydrogen gas in the filler gas further.

As described above, the discharge tube of the present invention is characterized by setting the concentration of the hydrogen gas in the filler gas in a range from 20% by volume to 80% by volume.

Moreover, in the above-described embodiments, the filler gas enclosed in the discharge tube is composed of a mixture of argon (Ar) gas and hydrogen ($H_2$) gas. However, the chemical composition of the filler gas according to the present invention is not limited to the above-described embodiments. Alternatively, a mixture of argon (Ar) gas, neon (Ne) gas, and hydrogen ($H_2$) gas may be suitably used for the filler gas in the discharge tube of the invention if the concentration of the hydrogen gas in the filler gas is set in the range from 20% by volume to 80% by volume. In such alternative embodiment, the operating voltage of the discharge tube is set in a voltage range from 200V to 3000V.

Alternatively, a mixture of argon (Ar) gas, xenon (Xe) gas, and hydrogen ($H_2$) gas may be suitably used for the filler gas in the discharge tube of the invention if the concentration of the hydrogen gas in the filler gas is set in the range from 20% by volume to 80% by volume. In such alternative embodiment, the operating voltage of the discharge tube is set in a voltage range from 5000V to 8000V.

According to the discharge tube of the invention, it is possible to suppress the occurrence of the rebound phenomenon immediately after a start of discharging. Moreover, according to the discharge tube of the invention, it is possible to suppress the decline of the electric discharge life of the discharge electrode. Moreover, according to the discharge tube of the invention, it is possible to attain the stabilization of the discharge starting voltage.

The present invention is not limited to the above-described embodiments, and variations and modifications may be made without departing from the scope of the present invention.

What is claimed is:

1. A discharge tube comprising:

a filler gas being composed of a mixture of inert gas and hydrogen gas;

an airtight cylinder in which the filler gas is enclosed in an airtight manner; and a pair of first and second discharge electrodes opposed to each other within an internal space of the airtight cylinder, so that an electric discharge is generated between discharging surfaces of the first and second discharge electrodes;

wherein a concentration of the hydrogen gas in the filler gas is set in a range from 20 percent by volume to 80 percent by volume, and wherein the inert gas contained in the filler gas comprises argon gas and xenon gas.

2. The discharge tube according to claim 1 wherein an operating voltage of the discharge tube after a start of discharging is set in a range from 400V to 6000V.

3. The discharge tube according to claim 1 wherein the first and second discharge electrodes are made of a metallic material which is chosen from among Fe—Ni—Co alloy, Fe—Ni alloy and Fe—Ni—Cr alloy.

4. The discharge tube according to claim 1 wherein each of the first and second discharge electrodes comprises a copper plating on the discharging surface thereof.

5. The discharge tube according to claim 1 wherein an operating voltage of the discharge tube after a start of discharging is set in a range from 5000V to 8000V.

6. The discharge tube according to claim 1 wherein the concentration of the hydrogen gas in the filler gas is set to be above 40 percent by volume, in order to allow the operating voltage of the discharge tube after the start of discharging to be reduced to a ground voltage in a straight manner and avoid a rebound phenomenon.

7. A discharge tube comprising:

a filler gas being composed of a mixture of inert gas and hydrogen gas;

an airtight cylinder in which the filler gas is enclosed in an airtight manner; and a pair of first and second discharge electrodes opposed to each other within an internal space of the airtight cylinder, so that an electric discharge is generated between discharging surfaces of the first and second discharge electrodes;

wherein a concentration of the hydrogen gas in the filler gas is set in a range from 20 percent by volume to 80 percent by volume, and wherein the inert gas contained in the filler gas comprises argon gas and neon gas.

8. The discharge tube according to claim 7 wherein an operating voltage of the discharge tube after a start of discharging is set in a range from 200V to 3000V.

* * * * *